United States Patent [19]

Klievoneit

[11] Patent Number: 4,509,298

[45] Date of Patent: Apr. 9, 1985

[54] PNEUMATIC CLAMP MOUNTING FOR A DISC

[75] Inventor: Harold R. Klievoneit, Mesa, Ariz.

[73] Assignee: St. Florian Company, Ltd., Phoenix, Ariz.

[21] Appl. No.: 400,303

[22] Filed: Jul. 21, 1982

[51] Int. Cl.[3] ..... B25B 5/00

[52] U.S. Cl. ..... 51/237 R; 279/2 R; 279/106; 279/4; 51/227 R; 269/22; 269/50

[58] Field of Search ..... 51/134, 217 R, 217 T, 51/237 R, 237 T, 118, 227 R; 269/22, 32, 274, 275, 47, 50, 238; 125/15; 279/1 W, 1 R, 2 R, 4 R, 106

[56] References Cited

U.S. PATENT DOCUMENTS

| | | | |
|---|---|---|---|
| 826,694 | 7/1906 | Shirley | 51/118 |
| 2,361,763 | 10/1944 | Goddard | 279/106 |
| 2,515,695 | 7/1950 | Caston | 51/237 T |
| 2,922,657 | 1/1960 | Garrison et al. | 51/227 R |
| 4,093,176 | 6/1978 | Constantin | 269/22 |

*Primary Examiner*—Frederick R. Schmidt
*Assistant Examiner*—Judy J. Hartman
*Attorney, Agent, or Firm*—Cahill, Sutton & Thomas

[57] ABSTRACT

Pneumatically operated clamping apparatus provides free floating mounting of a disc upon a shaft during grinding and polishing of the disc.

7 Claims, 6 Drawing Figures

FIG. 1
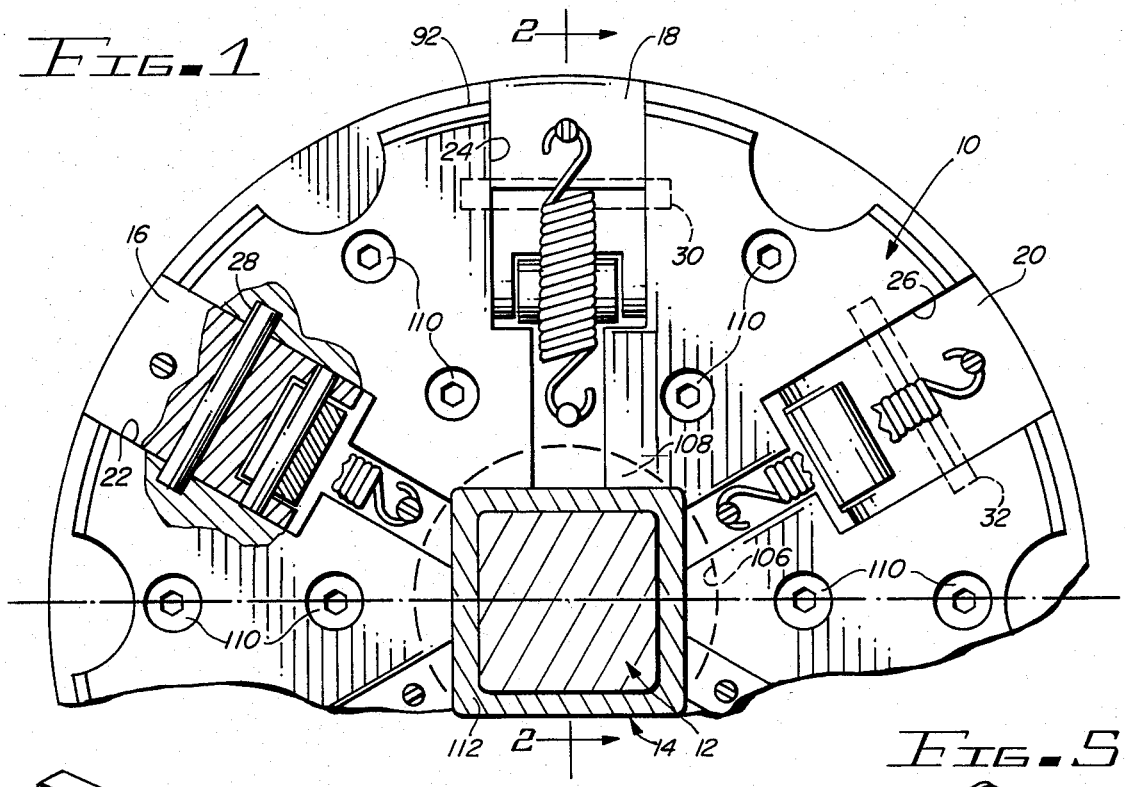
FIG. 5
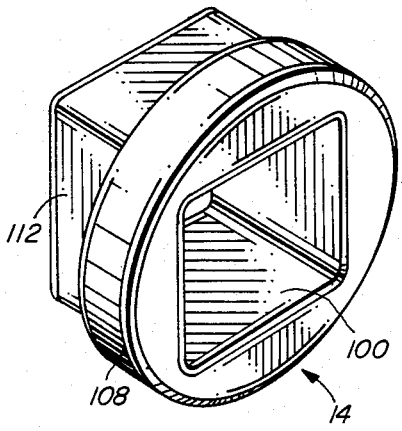
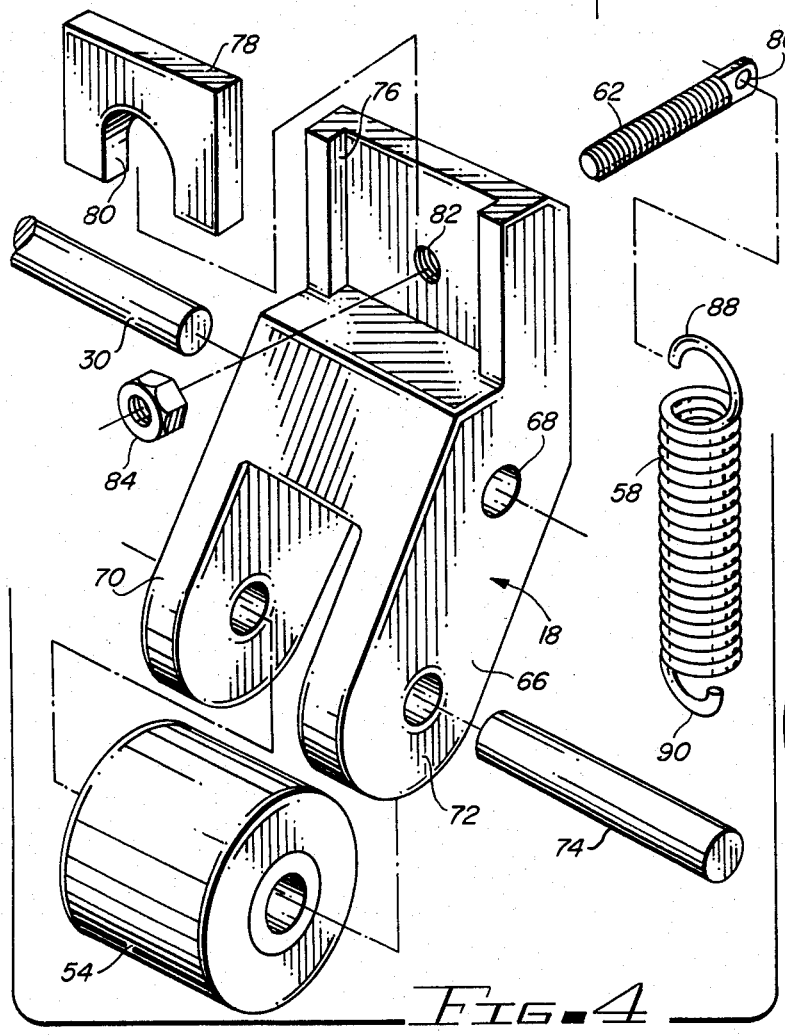
FIG. 4
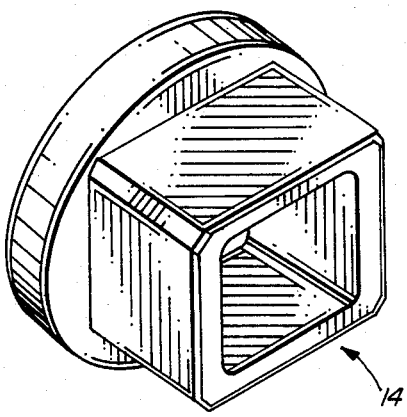
FIG. 6

FIG. 2
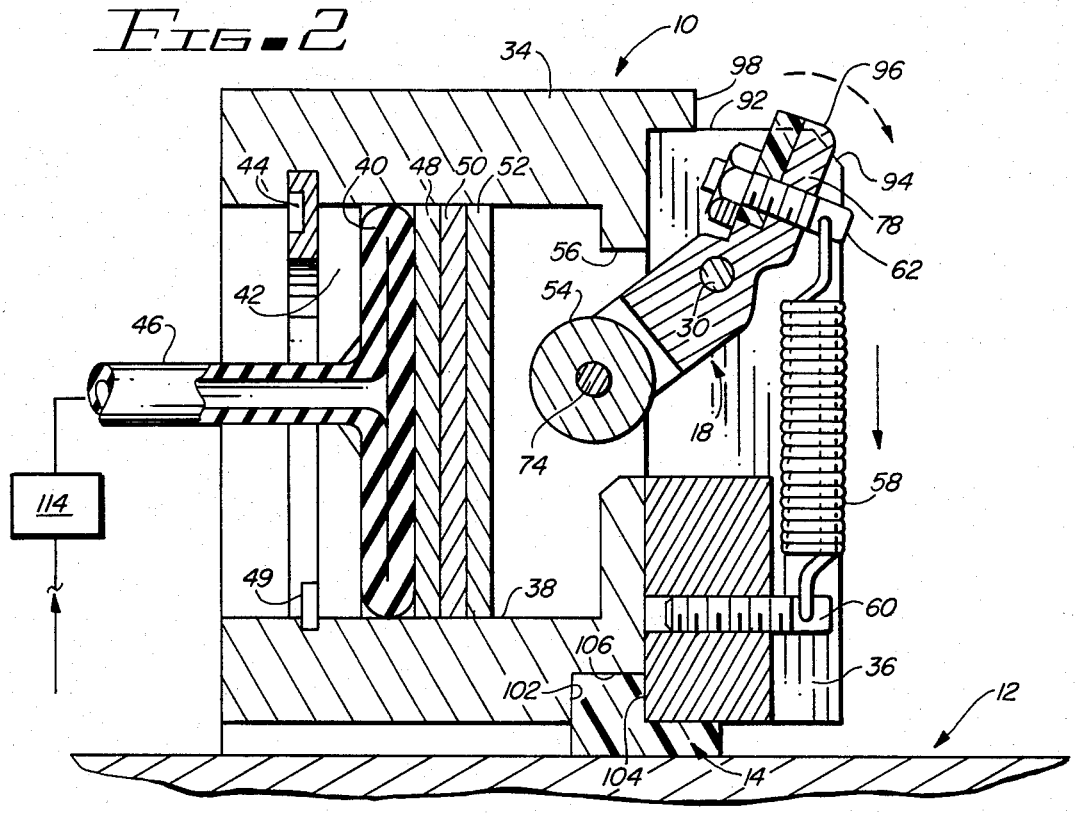
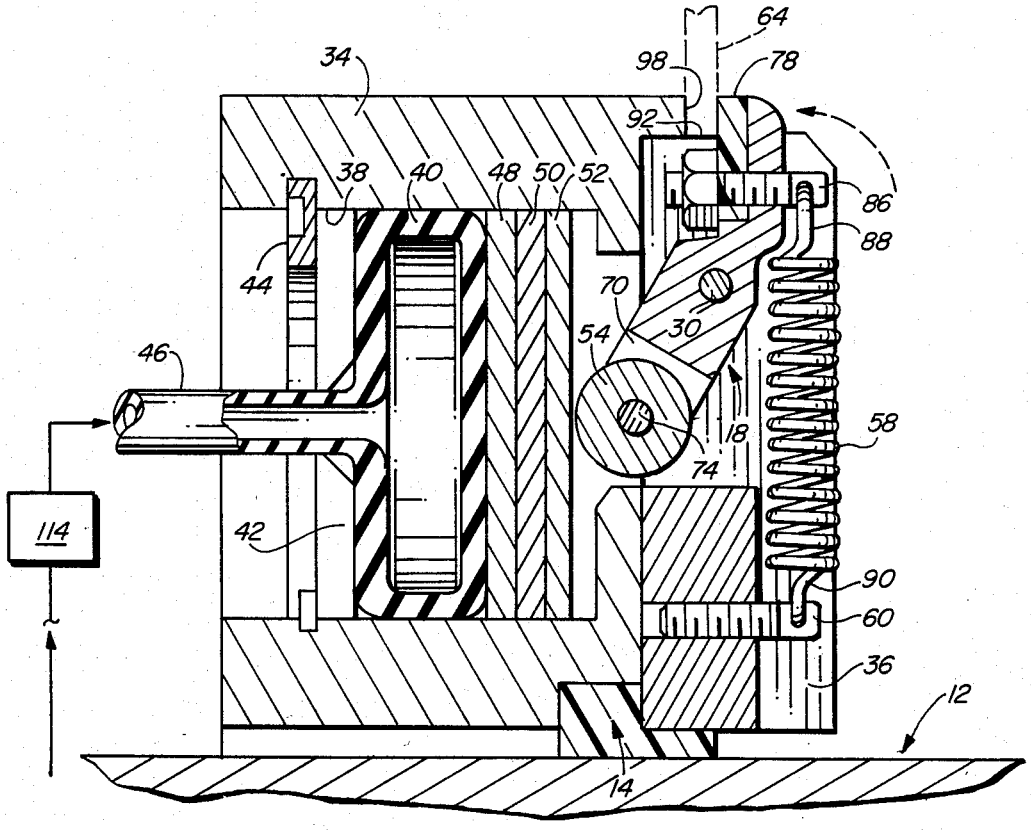
FIG. 3

PNEUMATIC CLAMP MOUNTING FOR A DISC

The present invention relates to mountings for discs and, more particularly, to pneumatically operated hub supported clamps for clamping and mounting a disc upon a rotating shaft.

The computer industry employs apertured discs of various sizes for storage and retrieval of information thereon. These discs must have parallel opposed sides polished to a tolerance of a few microns. Lesser quality polished discs seriously degrade the quantity and integrity of information storable upon and retrievable from the discs.

Prior art apparatus for obtaining a peripheral grind-/polish mounts each disc upon a rotating shaft to locate the disc intermediate to opposed grinding/polishing heads. The mounting means is generally a chuck type mounting for rigidly mechanically attaching the disc to its supporting shaft. Alternatively, the clamp may be one or more manually operated mechanical clamps for securing the disc upon its shaft. Travel of the disc along the longitudinal axis of its mounting shaft necessitated by wear upon the grinding/polishing heads is effected through longitudinal repositioning of the shaft or periodically reclamping the disc along the shaft.

The handling of the disc during mechanical clamping and unclamping of the disc creates a substantial hazard of scratching or other wise damaging the disc.

While a disc is being ground/polished, it will experience a substantial temperature rise. The prior art clamping mechanisms mechanically rigidly retain the inner diameter of the disc and expansion of the disc due to heating thereof is not readily accommodated. The resulting lack of accommodation may result in the disc becoming dished out or otherwise temporarily or permanently deformed. Any such deformation will tend to result in uneven grinding/polishing and be detrimental to the quality of the finished product.

The prior art mechanical clamps require substantial operator attention during clamping and unclamping. Such attention is costly from the standpoint of operator time and is costly from the standpoint of overall machine time required to grind/polish a disc.

It is therefore a primary object of the present invention to provide an automated clamp mounting for retaining a disc upon a rotating shaft.

Another object of the present invention is to provide a free-floating mounting for a disc upon a shaft.

Yet another object of the present invention is to provide clamps for a disc which deter deformation of a disc due to thermal expansion/contraction.

Still another object of the present invention is to provide clamps which periodically and automatically alter the clamping points of a clamped disc.

A further object of the present invention is to provide pneumatically operated clamps for a shaft mounted disc.

A yet further object of the present invention is to provide pneumatically operated clamps for a free-floating mounting of a disc upon a shaft.

A still further object of the present invention is to provide a mounting having pneumatic clamps for rotating a disc commensurate with rotation of a supporting shaft while providing rectilinear excursion of the disc along and tilting of the disc about the shaft.

These and other objects of the present invention will become apparent to those skilled in the art as the description thereof proceeds.

The present invention will be described in greater specificity with reference to the following drawings, in which:

FIG. 1 is a partial view of a shaft mounted hub embodying a plurality of clamps;

FIG. 2 is a cross-sectional view taen along lines 2—2, as shown in FIG. 1 and illustrating a clamp in its unactuated position;

FIG. 3 is similar to FIG. 2 but shows a clamp in its actuated position;

FIG. 4 is an isometric view of various elements of the clamp;

FIG. 5 is a perspective view illustrating a collar interconnecting the hub with a shaft; and FIG. 6 is a further perspective view illustrating the collar.

Referring to FIG. 1 there is shown a hub 10 mounted upon a shaft 12, which shaft is square in cross-section. A collar 14 interconnects the shaft with the hub to insure rotation of the hub commensurate with rotation of the shaft. Three of a plurality of dogs 16, 18 and 20, are pivotally mounted within slots 22, 24 and 26 in the hub by pivot pins 28, 30 and 32, respectively. These pivot pins are journaled within their respective dogs and the opposed ends of each are located within cavities disposed in opposed sides of the respective slots.

Referring jointly to FIGS. 1, 2 and 3, the structure of hub 10 will be described. The hub includes a housing 34 and a face plate 36 attached to the housing. An annular cavity 38 is formed within the housing for receiving an annular air bladder 40. An annular retainer plate 42 is maintained within the annular cavity by a snap ring 44, or the like, to retain the bladder within the cavity. The air bladder, on expansion due to injection of air thereinto through inlet 46 for a source of air, produces translation within the cavity and along the axis of shaft 12 of three annular plates, a steel plate 48, a rubber plate 50 and a nylon plate 52.

The lower end of dog 18 includes a rotatably mounted roller 54 extending into cavity 38 through an aperture 56. A coil spring 58 extends radially from an anchor stud 60, which stud is in threaded engagement with face plate 36, to a point of attachment on dog 18. The point of attachment may be a threaded stud 62 geometrically located to urge pivotal movement of dog 18 to locate roller 54 as far as possible into cavity 38.

As particularly illustrated in FIG. 3, on flow of air under pressure from the source of air, bladder 40 will expand. The expansion will force translatory movement of plates 48, 50 and 52 toward and against roller 54 of dog 18. The force exerted upon the roller will cause the dog to pivot counter to the bias applied by coil spring 58. For reasons which will be described in further detail below, the resulting pivotal movement of dog 18, along with similar movement of the other dogs mounted upon hub 10, will result in clamping of a disc 64 to the hub. Upon relief of the air pressure within bladder 40, springs (not shown) within cavity 38 acting upon one or another of plates 48, 50 and 52; other means may be employed to deflate the bladder. Upon such deflation, the plates will be translated towards the bladder and dog 18, along with the other dogs, in response to the force applied by its coil spring, will pivot out of clamping contact with the disc. It is contemplated that coil spring 58 and its brethren, may be the means employed for deflating the bladder and for repositioning plates 48, 50 and 52 upon release of the air pressure within the bladder.

These plates are employed for the following reasons. Plate 48 is of steel to ensure uniform application of force against each roller and uniform clamping pressure against the disc by each clamp. Plate 50 is of rubber or other material to serve as a gasket to prevent incursion of oil, ground disc material and residue from the grinding heads adjacent the bladder. Plate 52 is of nylon to provide a good wear surface for the rollers.

Referring specifically to FIG. 4, the structure of dog 18 will be described in greater detail. The dog includes a lever 66 having an aperture 68 for penetrably receiving pivot pin 30. A pair of arms 70, 72 locate therebetween roller 54, which roller is pivotally mounted upon pin 74 retained by the arms. The upper end of lever 66 includes a mortise 76 for receiving an insert or tab 78. The tab may be a rectangular block of nylon force fitted within mortise 76. A cut out 80 in the lower edge of tab 78 accommodates extension of stud 62 through threaded aperture 82 and its locking nut 84. The extending end of stud 62 may include an aperture 86 for penetrably receiving end 88 of coil spring 58. Opposed end 90 of the coil spring may be similarly retained by stud 60 (see FIG. 2).

Referring to FIGS. 1 and 2, hub 10 includes housing 34, which housing primarily supports bladder 40 and its actuating plates 48, 50 and 52 disposed within annular cavity 38, and face plate 36, which face plate primarily pivotally supports each of the dogs. Face plate 36 also includes a peripheral surface 92, which surface serves in the manner of guide means or spindle for seating disc 64, as shown in FIG. 3. The edge of the face plate is beveled to form a truncated cone shaped guiding surface or guide 94 for ease in mounting discs 64 upon the spindle. As particularly illustrated in FIG. 2, the outer edge of tab 78 is essentially coincident with the mid point of guide 94. Thereby, on rotation of dog 18 (and the remaining dogs), the tab will extend radially of junction 96, the intersection between guide 94 and surface 92, to mechanically engage a disc located anywhere along surface 92. Upon such engagement of the disc by the dogs, the disc will be translated along the axis of the spindle under force of the dogs until it abuts radially oriented shoulder 98, which shoulder is formed by an annular surface of housing 34 extending radially of surface 92. To insure trueness of the disc mounting adjacent shoulder 98, the shoulder is carefully machined to be perpendicular to the axis of rotation of hub 10. By inspection, upon deflation of bladder 40, the dogs will be repositioned under force of their respective coil springs to locate the respective tabs radially inwardly of surface 92 whereby removal of the disc is unimpeded by the dogs.

Hub 10 is mounted upon shaft 12 by means of collar 14 shown in FIGS. 5 and 6. The collar includes a passageway 100 square in cross-section to mate with the cross-section of shaft 12 but with sufficient tolerance to permit sliding of the collar therealong without permitting any independent rotation therebetween. An internal radially oriented annular depression is formed within housing 34, which depression, in combination with radial surface 104 of face plate 36 defines a radially oriented annular channel 106. Circular ridge 108 extending about collar 14 is configured to be compressively retained within channel 106 upon attachment of face plate 36 to housing 34 by retaining means 110 (illustrated in FIG. 1). The nonslip fit between collar 14 and hub 10 precludes independent rotation between the hub and the collar whereby any rotation of shaft 12 is translated into commensurate rotation of the hub.

A deliberate clearance between the surfaces of skirt 112 of collar 14 and the corresponding surfaces of face plate 36 (see FIGS. 2 and 3) accommodates tilting of the hub with respect to the shaft commensurate with flexibility of the collar and particularly ridge 108. To provide such deliberate flexibility, the collar may be made of nylon or other similar material which is mechanically robust, easily machined to close tolerances and yet provides a latitude of flexibility without permanent deformation.

The means for introducing air under pressure into bladder 40 and relieving the pressure of such air may be effected by any of well known techniques. In example, there are presently commercially available fittings, generically identified by numeral 114 in FIG. 3, for conveying air under pressure from a source through shaft 12 and into inlet 46. Details of such devices are not shown as they are well known to those skilled in the art.

In operation, during normal grinding/polishing, the direction of rotation of disc 64 is usually reversed at least once and usually several times for various reasons. Because of the automated capability of the presently described disc clamp apparatus, it is feasible to unclamp the disc each time reversal of rotation is to be effected and reclamp the disc upon commencement of rotation in the other direction. Such reclamping has several benefits. First, it relieves any internal stresses developed within the disc due to heating and the disc will have no tendency to become dished or bowed. Second, each time the rotation is initiated the resulting jerk will angularly reposition the disc upon the spindle. And, third, the disc is clamped at multiple locations for each grinding/polishing operation, which multiple point of clamping will cancel any nonuniformity of grind due to disc deformation caused by the clamping itself.

The hub can accommodate, by tilting, any disparity in alignment between the plane of grind and the axis of rotation of hub 10. Translation of the disc along its shaft to accommodate wear of one or both of the grinding heads is automatically effected to assure equal grinding/polishing pressures upon opposed sides of the disc.

By employing a relatively wide surface 92 serving as a spindle for the disc, any tilting of the disc between the time of manual or mechanical placement of the disc upon the spindle and energization of the clamps will not cause the disc to fall off the signals. The geometry of the dogs in relation to surface 92 and shoulder 98 assures that each dog will engage the disc and transport it, if necessary, to a position adjacent the shoulder, whereby manual or automated mounting of the disc upon the spindle may be of minimum accuracy. And, the hub may be readily altered in size and number of dogs to accommodate any sized disc without departing from the principle of operation of the present invention.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A pneumatic clamp apparatus for retaining an apertured disc upon a shaft during grinding and polishing of the disc, said apparatus comprising in combination:

(a) an hub for penetrably engaging and supporting the disc, said hub including an annular cavity;

(b) an annular shoulder for locating the disc upon the hub;

(c) a plurality of clamps for clamping the disc upon said hub;

(d) means for biasing each clamp of said plurality of clamps;

(e) means for pivotally mounting each of said clamps;

(f) pneumatic means for urging pivotal movement of said plurality of clamps, said pneumatic means including an annular bladder operatively associated with said annular cavity and means for operating said plurality of clamps in response to inflation and deflation of said bladder; and (g) means for slidably locating and rotationally locking said hub upon the shaft.

2. The apparatus as set forth in claim 1 wherein said locating and locking means provides limited tilting movement of said hub.

3. A pneumatic clamp apparatus for retaining an apertured disc upon a shaft during grinding and polishing of the disc, said apparatus comprising in combination:

(a) a hub for penetrably engaging and supporting the disc, said hub including an annular cavity;

(b) an annular shoulder for locating the disc upon the hub;

(c) a plurality of clamps for clamping the disc upon said hub;

(d) means for biasing each clamp of said plurality of clamps;

(e) means for pivotally mounting each of said clamps;

(f) pneumatic means for urging pivotal movement of said plurality of clamps, said pneumatic means including an annular bladder operatively associated with said annular cavity and means for operating said clamps in response to inflation and deflation of said bladder;

(g) each said mounting means including a pin for pivotally supporting each of said clamps and a roller responsive to said operating means for translating motion of said operating means into pivotal motion of each of said clamps about the respective one of said pins; and (h) means for slidably locating and rotationally locking said hub upon the shaft.

4. The apparatus as set forth in claim 3 wherein each of said plurality of clamps includes an insert for making contact with the disc.

5. Apparatus as set forth in claim 3 wherein said hub includes guide means for locating the disc adjacent said shoulder on actuation of said pneumatic means.

6. The apparatus as set forth in claim 5 wherein said hub comprises a housing for supporting said pneumatic means, said mounting means and said plurality of clamps and a face plate secured to said housing and defining a junction therebetween for supporting said bias means and said guide means.

7. The apparatus as set forth in claim 6 wherein the junction between said housing and said face plate defines said shoulder.

* * * * *